US008540460B2

(12) United States Patent
Pallini et al.

(10) Patent No.: US 8,540,460 B2
(45) Date of Patent: Sep. 24, 2013

(54) SYSTEM FOR SUPPLEMENTAL TENSIONING FOR ENHANCED PLATFORM DESIGN AND RELATED METHODS

(75) Inventors: Joe Pallini, Tomball, TX (US); Steve Wong, Houston, TX (US); Fife B. Ellis, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 253 days.

(21) Appl. No.: 12/909,722

(22) Filed: Oct. 21, 2010

(65) Prior Publication Data

US 2012/0099930 A1 Apr. 26, 2012

(51) Int. Cl.
*E02D 15/02* (2006.01)

(52) U.S. Cl.
USPC ..... 405/224.4

(58) Field of Classification Search
USPC ..... 405/224.4, 224.2, 224, 223.1
See application file for complete search history.

(56) References Cited

U.S. PATENT DOCUMENTS

| | | | | |
|---|---|---|---|---|
| 3,824,943 | A | 7/1974 | Mo | |
| 4,606,673 | A | 8/1986 | Daniell | |
| 4,913,238 | A * | 4/1990 | Danazcko et al. | 405/223.1 |
| 5,427,180 | A * | 6/1995 | dePaiva Leite et al. | 166/355 |
| 5,439,321 | A * | 8/1995 | Hunter | 405/195.1 |
| 5,513,929 | A | 5/1996 | Calkins | |
| 5,542,783 | A * | 8/1996 | Pollack | 405/223.1 |
| 5,697,447 | A * | 12/1997 | Børseth | 166/366 |
| 6,113,314 | A * | 9/2000 | Campbell | 405/224 |
| 6,488,447 | B1 * | 12/2002 | Nish et al. | 405/224.2 |
| 6,554,072 | B1 * | 4/2003 | Mournian et al. | 166/355 |
| 6,648,074 | B2 * | 11/2003 | Finn et al. | 166/350 |
| 6,666,624 | B2 * | 12/2003 | Wetch | 405/205 |
| 6,679,331 | B2 * | 1/2004 | Cordy et al. | 166/367 |
| 6,691,784 | B1 * | 2/2004 | Wanvik | 166/355 |
| 6,712,560 | B1 * | 3/2004 | Cottrell | 405/224.4 |
| 7,096,958 | B2 * | 8/2006 | Karayaka et al. | 166/367 |
| 7,281,483 | B1 | 10/2007 | Horton | |
| 7,329,070 | B1 * | 2/2008 | Trent et al. | 405/224.4 |
| 7,413,384 | B2 | 8/2008 | Horton | |

(Continued)

FOREIGN PATENT DOCUMENTS

GB 2445479 A 7/2008

OTHER PUBLICATIONS

GB Search Report dated Dec. 14, 2011 from corresponding Application No. GB1118033.8.

(Continued)

*Primary Examiner* — Frederick L Lagman
*Assistant Examiner* — Patrick Lambe
(74) *Attorney, Agent, or Firm* — Bracewell & Giuliani LLP

(57) ABSTRACT

Riser management systems, apparatus, and methods to maintain a selected range of tension on a plurality of risers extending between subsea well equipment and a floating vessel, are provided. A riser management system can include a mono-buoyancy can platform operably coupled to a plurality of risers extending between subsea well equipment and a moored floating vessel, and a plurality of tensioner units each connected to a top portion of a separate one of the risers to provide tension to each of the risers. The mono-buoyancy can platform can provide tension to each of the risers sufficient to compensate for a relative vertical offset between the risers and the vessel due to vessel movement, which generally affects each of the risers equally, within tolerances, while the tensioner units can simultaneously provide tension to compensate for one or more additional factors which can affect each riser differently.

20 Claims, 8 Drawing Sheets

(56) References Cited

U.S. PATENT DOCUMENTS

| | | | | |
|---|---|---|---|---|
| 7,537,416 | B2 * | 5/2009 | Wetch | 405/224.2 |
| 7,632,044 | B2 * | 12/2009 | Pallini et al. | 405/224.4 |
| 7,914,234 | B2 * | 3/2011 | Large et al. | 405/224 |
| 2002/0000321 | A1 * | 1/2002 | Reynolds | 166/355 |
| 2002/0084077 | A1 * | 7/2002 | Finn et al. | 166/354 |
| 2003/0063953 | A1 * | 4/2003 | Beynet et al. | 405/224.4 |
| 2004/0105724 | A1 * | 6/2004 | Copple et al. | 405/195.1 |
| 2004/0253059 | A1 * | 12/2004 | Horton, III | 405/195.1 |
| 2005/0074296 | A1 * | 4/2005 | McCarty et al. | 405/224.4 |
| 2005/0129464 | A1 * | 6/2005 | Moncus et al. | 405/203 |
| 2009/0095485 | A1 | 4/2009 | Finn | |
| 2009/0226263 | A1 * | 9/2009 | Wetch | 405/224.4 |
| 2009/0321592 | A1 * | 12/2009 | Bryant et al. | 248/178.1 |
| 2010/0143047 | A1 | 6/2010 | Pallini | |
| 2010/0254767 | A1 * | 10/2010 | Pallini et al. | 405/223.1 |
| 2010/0260556 | A1 * | 10/2010 | Pallini et al. | 405/224.4 |
| 2011/0253027 | A1 * | 10/2011 | Legras | 114/333 |

OTHER PUBLICATIONS

Article describing Spar Platform, found at www.globalsecurity.org/military/systems/ship/platform-spar.htm, Nov. 2006.

Article describing Tension Leg Platform, found at www.globalsecurity.org/military/systems/ship/platform-tension-leg.htm, Nov. 2006.

* cited by examiner

SYSTEM FOR SUPPLEMENTAL TENSIONING FOR ENHANCED PLATFORM DESIGN AND RELATED METHODS

BACKGROUND OF THE INVENTION

1. Field of the Invention

This invention relates to tensioning of seabed-to-vessel marine risers. More particularly, this invention relates to tensioning the marine risers with a plurality of tensioning units in combination with a decoupled buoyancy can platform.

2. Description of the Related Art

A problem presented by offshore hydrocarbon drilling and producing operations conducted from a floating platform is the need to establish a sealed fluid pathway between each borehole or well at the ocean floor and the deck of the platform at the ocean surface. A riser typically provides this sealed fluid pathway. In drilling operations, the drill string extends through a drilling riser serving to protect the drill string and to provide a return pathway outside the drill string for drilling fluids. In producing operations, a plurality of production risers are used to provide a pathway for the transmission of hydrocarbons or other production fluid from multiple wells to the deck.

Each riser is typically projected up through an opening referred to as a moon pool in the vessel to working equipment and connections proximate an operational floor on the vessel. A riser pipe operating on the floating vessel in water depths greater than about 200 feet (34.72 meters) can buckle under the influence of its own weight and the weight of drilling fluid contained within the riser if it is not partially or completely supported. For floating platforms, the risers must be tensioned to maintain each riser within a range of safe operating tensions as the work deck moves relative to the upper portion of the riser. If a portion of the riser is permitted to go into compression, it could be damaged by buckling or by bending and colliding with adjacent risers. It is also necessary to ensure that the riser is not over-tensioned when the vessel hull moves to an extreme lateral or vertical position, such as, for example, when under extreme wave conditions or when ocean currents exert a significant side loading on the riser.

There are two primary types of tensioning systems: those that use long-stroke top-mounted tensioners (hydraulic, pneumatic, or hydra-pneumatic cylinders connected between the top of the riser and the vessel hull); and those that use buoyancy can tensioners (floatation devices connected to the upper portion of the each riser). The top-mounted tensioning systems function are either passive or active. The passive top-mounted tensioning systems include long-stroke tensioners that utilize cylinders with a stroke of typically between 15 and 30 feet in order to compensate for the movement expected due to deepwater operations. The active top-mounted tensioning systems further include a control system that actively adjusts hydraulic pressure of each long stroke tensioner cylinder to maintain a relatively constant tension on its associated riser. For both the passive and active top-mounted tensioning systems, abrupt lateral and vertical movements of the vessel hull are compensated for by the stroke of the tensioner. The buoyancy can tensioning systems, on the other hand, function by connecting buoyant cans, either individually, or collectively, to the top of each riser at a location below the water line to maintain a relatively constant tension, with abrupt lateral and vertical movements of the vessel hull being compensated for by allowing the buoyancy can and/or riser to slide up and down guide supports extending through the hull.

One of the problems related to offshore platforms that operate in deep and ultra-deep water (5000-10000+ foot water depth) is the amount or degree of lateral offset that is associated with the platform. The lateral offset, which results in a vertical differential between riser and vessel, is essentially controlled by the type of platform and the mooring system that is utilized. As water depths become deeper, however, regardless of the platform used, the lateral offsets increase. With floating production platforms such as SPAR's, which typically employ a top tensioned system of long-stroke tensioners, this lateral offset drives the total stroke requirements of the tensioning system. As a result, the stroke requirements can easily exceed 25-30 feet and, in active tensioning systems, require actively adjusting hydraulic pressure to increase pressure in the tensioning cylinders needed to maintain sufficient tension on the riser during a heave downward by the vessel and to reduce pressure in the tensioners to prevent the application of excessive tension to the risers during a heave upward by the vessel.

As such, it has been recognized by the inventors that the conditions associated with deep and ultradeep water inevitably result in a tensioning system made up of multiple cylinders, typically upwards of 25 feet in length, and capable of stroking the required 25-30 feet, along with significant space requirements within the vessel and/or an additional support frame or deck to support the non-stroking portion of the tensioner's cylinders, which can greatly add to the cost of the vessel to accommodate the 25-30 ft. stroke. By analogy, this can be equated to having to build a house with 25 foot high doorways and ceilings in every room of the house to accommodate the stroking portion of the tensioner's cylinders, rather than a normal single story having a six or eight foot doorway. Further, active tensioning systems can require a computerized control and feedback system and additional accumulators, gas pumps, pressure sensors, etc. These long-stroke tensioners can add significant extra weight to the hull supporting the production platform, and can significantly add to the costs of the riser management system. As exploration takes the industry into areas where the environmental and operational conditions, it is anticipated that there will be more and more instances where conditions exceed the current stroke capabilities of long-stroke top-mounted tensioning systems, which can lead to even higher costs.

Alternative designs to the long-stroke top-mounted tensioning systems have been employed to resolve the total stroke requirements. Such alternatives include the employment of a multi-buoyancy can system, described previously, which includes a set of individual buoyancy cans separately connected to a corresponding set of individual risers. Such systems, however, have some significant disadvantages. Such disadvantages include installation complexity, questionable storm resistance, stick-slip issues (e.g., due to contact with the side walls of the guide supports or columns), and buoyancy force limitations (e.g., resulting from a trade-off between the size of the individual buoyancy cans, the number of cans and risers supportable by the hull, and hull size. That is, for a given size hull, the larger the can the less number of risers supportable by the vessel. Similarly, for a given number of risers, the larger the cans, the larger the hull must be to support the risers, and the larger the costs of building, maintaining, and operating the vessel.

Another alternate platform design that solves some of these issues uses a "de-coupled" platform approach. Examples of such alternative platform design includes the riser support systems described, for example, in U.S. Pat. No. 7,537,416 and in U.S. Patent Publication No. 2009/009545, each incorporated by reference in its entirety. In essence, to employ such de-coupled approach, multiple production risers are immovably attached to one common, large air "mono-can" in such a fashion that the risers extend through the interstitial space between the air can cells, thus, de-coupling the production risers from the hull. In this design approach, the hull structure is laterally restrained and is independently moored and detached from the mono buoyancy can platform so as to allow the mono buoyancy can platform and risers to slide up and down guide supports extending through the hull. That is, this design approach employs the mono-can assembly as its substitute for long stroke tensioners to compensate for lateral offset.

Recognized by the inventors, however, is that while most of the total stroke requirements of a riser are directly related to vessel offset which generally effects each riser of a set of risers in a same manner and level, and thus, can be compensated for through utilization of a single buoyancy can platform, a small percentage of the stroke requirements are a result of factors which can affect each separate riser of the set of risers in a different manner or at least to a different level. These factors can include, for example, a change in riser initial length, riser initial weight, riser initial pre-tension, thermal growth, subsea wellhead and surface tree spacing distance, and pressure differentials between risers, which cannot be readily compensated for by a single de-coupled buoyancy can platform. Accordingly, it is recognized that although the single mono-buoyancy can- (multiple riser) decoupled platform system is an improvement upon the single-buoyancy can (single riser) platform approach, the mono-buoyancy can (decoupled) platform system still falls short of replacing long-stroke top-mounted tensioning systems, as it does not resolve this "small" but significant percentage of stroke requirements. It is further recognized that, as a result, such system will be expected to cause large tension variations between risers being held by the mono buoyancy can platform, as it assumes that environmental and operational variations have an equal effect on each riser in the set of risers, which can resultingly at least reduce the service life of one or more the risers, if not ultimately result in a catastrophic failure of one or more of the risers.

Accordingly, the inventors have further recognized the need for a riser tensioning system which can compensate for both lateral offset and additional factors such as thermal growth, subsea wellhead and surface tree spacing distance, and pressure differentials between risers, among others, without the need for long-stroke tensioners, or more significantly, the associated costs to the riser management system and the vessel associated with accommodating their significant size requirements.

SUMMARY OF THE INVENTION

In view of the foregoing, various embodiments of the present invention advantageously provide a riser tensioning system which can adequately compensate for both lateral offset and additional factors such as thermal growth, subsea wellhead and surface tree spacing distance, and pressure differentials between risers, among others, without the need for the vessel modifications needed to accommodate long-stroke tensioner units or the associated additional weight or associated additional costs. Further, various embodiments of the present invention can advantageously solve the problems associated with stroke variations on the "de-coupled" mono-can platform configuration, through use of a series of short-stroke tensioner units positioned atop the mono-buoyancy can platform, which provide a much lower cost tensioning system solution than that typically used on conventional SPAR or semi-submersible platforms. Advantageously, according to such configuration or configurations, the stroke variations among individual risers connected to the mono-buoyancy can platform can be handled by each individual tensioner unit while the tension requirements due to hull offset can be primarily handled by the "mono-can" platform. As a result, the variation in riser tension can be maintained nearly constant, or at least with a range of values, for variations in pressure, thermal growth and the various operating conditions separately affecting each individual riser. Further, as a result of application of a combination of short-stroke tensioner units with a mono-buoyancy can platform, even with a shorter stroke capability, various embodiments of the present invention can function adequately with a fixed gas volume and do not require active compensation. Also, as a result of application of a combination of short-stroke tensioner units with a mono-buoyancy can platform, various embodiments of the short-stroke tensioners may use a very small or even no gas volume to effectively work as a load/length adjusting device.

Specifically, according to an embodiment of the present invention, a riser management system can include a mono-buoyancy can platform operably coupled to a plurality of risers extending between subsea well equipment and a moored floating vessel and configured to be at least partially submerged, and a plurality of tensioner units each connected to a top portion of a separate one of the plurality of risers to provide tension to each of the plurality of risers. Advantageously, the mono-buoyancy can platform, operably coupled to the plurality of risers through the plurality of tensioner units and operably de-coupled from movement of the floating vessel, can provide tension to each of the plurality of risers sufficient to compensate for relative vertical movement between the risers and the vessel due to typically lateral vessel movement. This "vertical offset" generally affects each of the risers equally, within tolerances, while the tensioner units can simultaneously provide tension to compensate for one or more additional factors which can affect each riser differently—resulting in differential tension requirements between risers.

According to an exemplary configuration, the buoyancy can platform can include a plurality of buoyancy cans. Each of the plurality of buoyancy cans is operably coupled together to form the mono-buoyancy can platform configured to be at least partially submerged and positioned to collectively, rather than individually, provide tension to each of the risers sufficient to compensate for a vertical offset between the risers and the floating vessel. Similarly, each of the plurality of tensioner units include a plurality of cylinders having a top end portion or piston operably coupled to a riser connector for a respective one of the plurality of risers and a bottom end portion operably coupled to the mono-buoyancy can platform. Each of the cylinders for the respective tensioner unit can function collectively to provide tension to the riser to compensate for one or more additional factors other than/in addition to the vertical offset with the vessel. Further, according to the exemplary configuration, each of the risers, for example, via a riser connector, extend through the interstitial space between the plurality of buoyancy cans of the mono-buoyancy can platform. According to such configuration, the risers, although operably coupled to the respective plurality of tensioner units, due to the connection of the tensioner units to the buoyancy can platform, advantageously, the risers are operably de-coupled from movement of the floating vessel through coupling with the mono-buoyancy can platform.

Embodiment of the present invention also includes methods of maintaining a selected range of tension on a plurality of risers extending between subsea well equipment and a more floating vessel. The method can include coupling a plurality of risers to a corresponding plurality of tensioner units configured to adjust stroke length in response to movement of the respective riser in relation to a mono-buoyancy can platform decoupled from the vessel so as to allow vessel movement relative to a position of the buoyancy can platform; coupling the plurality of tensioner units to the mono-buoyancy can platform adapted to maintain tension on the plurality of risers within a certain range of tension values; and maintaining tension applied to each of the plurality of risers whereby tension is applied by a combination of both the plurality of tensioner units and the mono-buoyancy can platform, simultaneously, responsive to a change in the vertical offset in conjunction with a change in the one or more additional factors to thereby account for both the vertical offset and the additional factors

BRIEF DESCRIPTION OF THE DRAWINGS

So that the manner in which the features and advantages of the invention, as well as others which will become apparent, may be understood in more detail, a more particular description of the invention briefly summarized above may be had by reference to the embodiments thereof which are illustrated in the appended drawings, which form a part of this specification. It is to be noted, however, that the drawings illustrate only various embodiments of the invention and are therefore not to be considered limiting of the invention's scope as it may include other effective embodiments as well.

DETAILED DESCRIPTION

The present invention will now be described more fully hereinafter with reference to the accompanying drawings, which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout. Prime notation, if used, indicates similar elements in alternative embodiments.

As shown in FIGS. 1-10, various embodiments of the present invention employ and/or implement one or more of the above described principles in a new and unique manner in order to maintain a selected range of tension on a plurality of risers 21 extending between subsea well equipment 23 and a floating vessel 25 such as, for example, a conventional SPAR, TLP, or semi-submersible platform.

Figure 1:
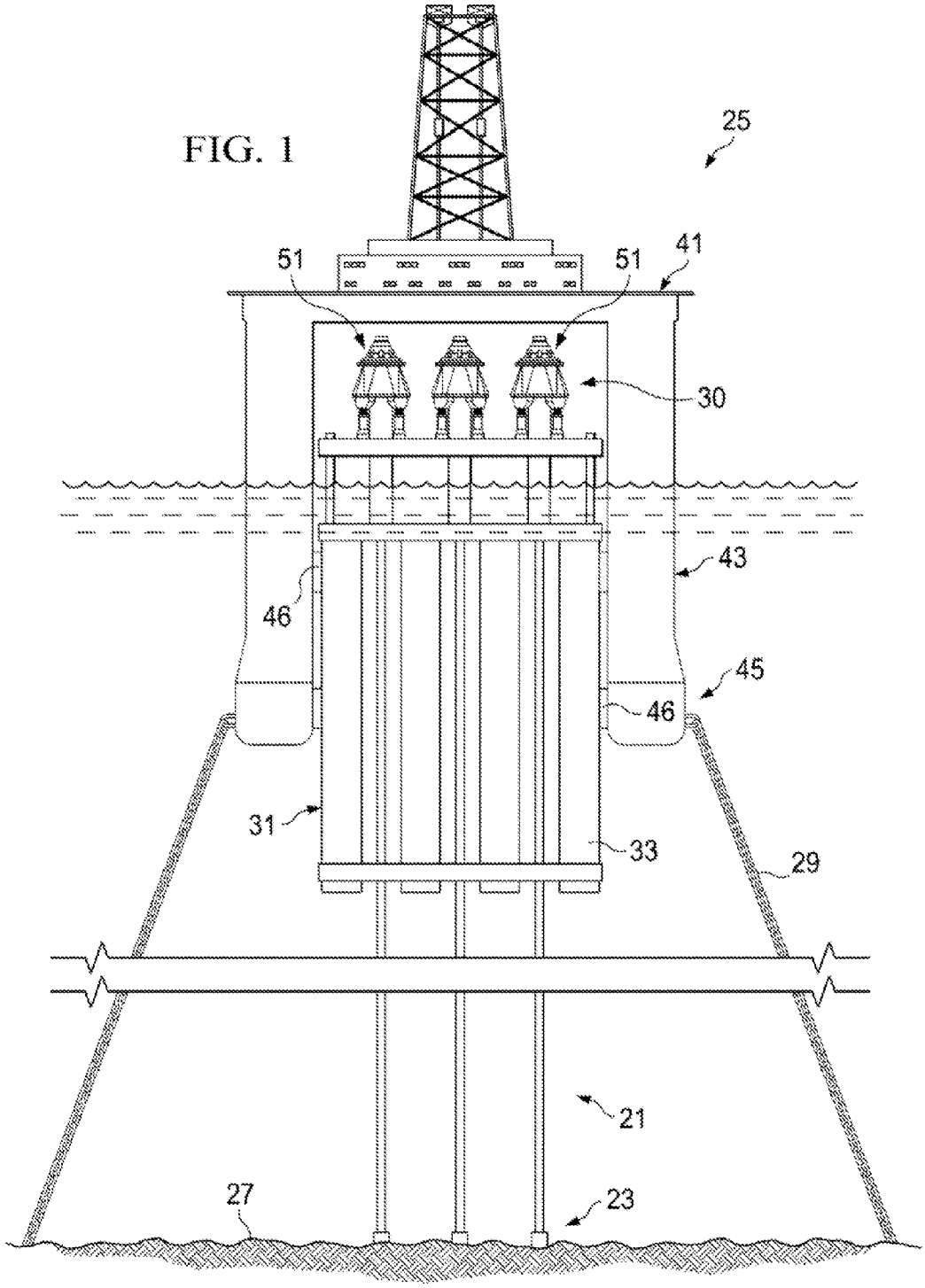
FIG. 1 is a perspective view of a riser management system for maintaining a selected range of tension on a plurality of risers extending between subsea well equipment and a floating vessel according to an embodiment of the present invention.
Figure 2:
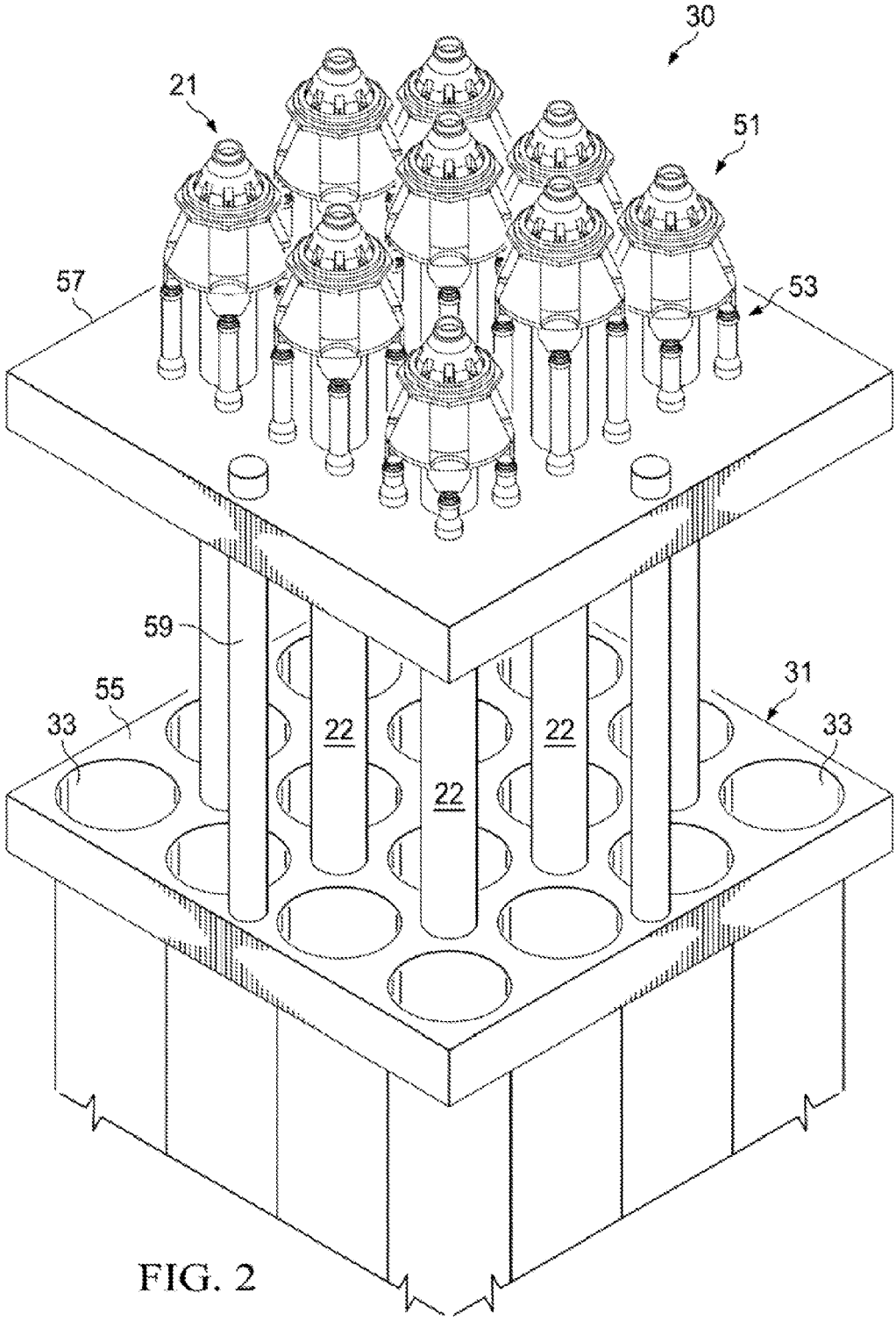
FIG. 2 is an enlarged perspective view of a plurality of short-stroke tensioner units of the riser management system of FIG. 1 each having a plurality of cylinders, positioned atop an upper surface of a mono-buoyancy can platform and connected to a corresponding plurality of risers at a plurality of different strokes and supported by an upper support frame according to an embodiment of the present invention.
Figure 4:
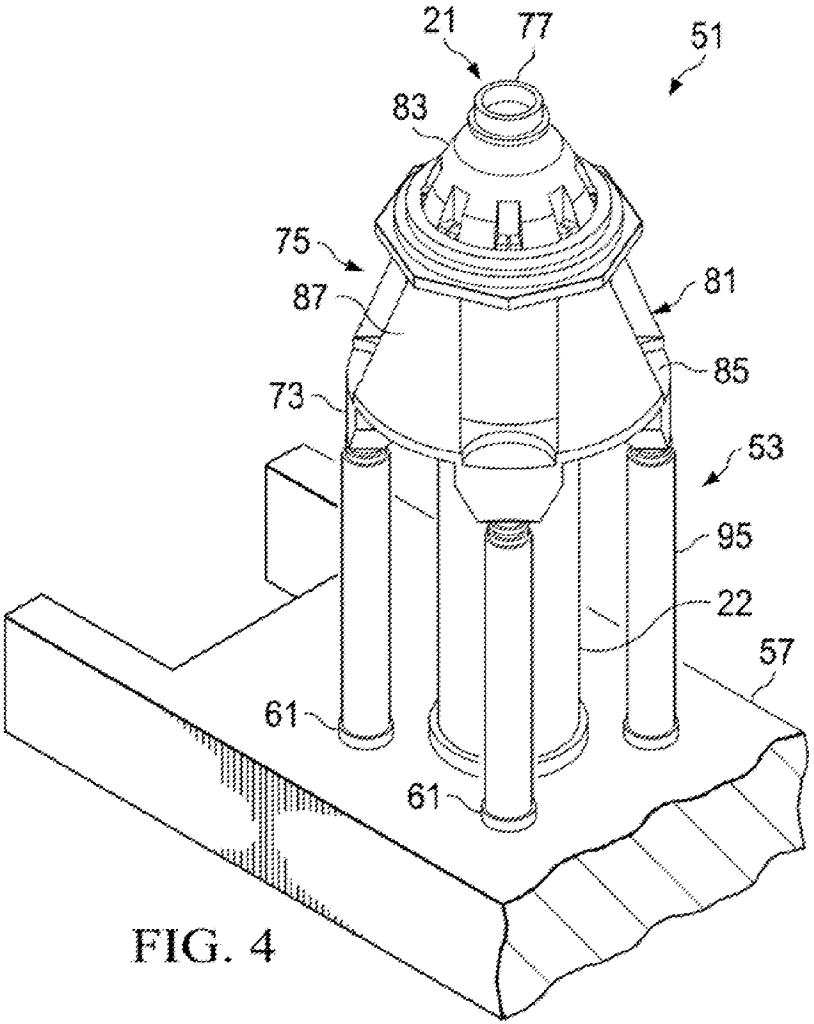
FIG. 4 is an enlarged perspective view of a single short-stroke tensioner unit of FIG. 3 connected to a single riser and embedded within a support frame according to an embodiment of the present invention.
Figure 3:
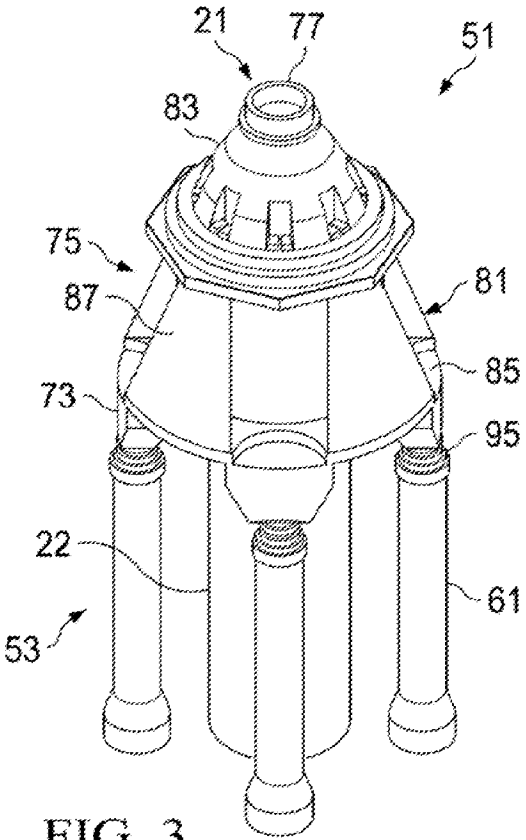
FIG. 3 is an enlarged perspective view of a single short-stroke tensioner unit of FIG. 2 connected to a single riser and shown with each of its cylinders in a retracted position according to an embodiment of the present invention.

FIG. 1 illustrates an environmental view of subsea well equipment 23 positioned on a surface of a subsea floor 27 connected to the hull structure of floating vessel 25 that is laterally restrained and independently moored by a plurality of cables 29, for example. FIG. 1 also illustrates a riser management system 30 for maintaining a selected range of tension on the risers 21 extending between subsea well equipment 23 and the floating vessel 25. The riser management system 30 includes a mono-buoyancy can platform 31 operably coupled to the risers 21 extending between the subsea well equipment 23 and the floating vessel 25. The mono-buoyancy can platform 31 is configured to be at least partially submerged and positioned to provide sufficient tension to each of the risers 21, simultaneously, to compensate, for example, for relative movement between the risers 21 and the floating vessel 25 caused by lateral offset of the floating vessel 25. As further shown in FIG. 2, the mono-buoyancy can platform 31 includes a plurality of buoyancy cans 33 operably coupled to risers 21 such that each of the buoyancy cans 33 forming separate independent buoyant chambers are operably coupled together to form the mono-buoyancy can platform 31. Note, it should be understood by one of ordinary skill in the art that a version of the mono-buoyancy can platform 31 having a single buoyant chamber is within the scope of the present invention. Such design, however, would not be preferred as it would be considered less survivable if damaged or punctured.

Referring again to FIG. 1, in a typical embodiment of a vessel, the vessel 25, for example, supports an upper deck 41. The vessel 25 also includes a middeck section 43 and a lower deck section 45 which can include compliant guides 46 positioned to provide lateral support between the vessel 25 and the buoyancy can platform 31 and to enable the vessel 25 and the buoyancy can platform 31 to rise and fall independently of each other in response to wave motions and/or changes in lateral offset between the vessel 25 and the subsea equipment 23.

Referring back to FIG. 2, shown is an enlarged perspective view of a plurality of short-stroke tensioner units 51 of the riser management system 30, each having typically three or four tensioning cylinders 53 (see also FIG. 3), positioned indirectly atop an upper surface 55 of the mono-buoyancy can platform 31 with each unit 51 connected to one of the risers 21, typically extending through a riser conductor 22. In the illustrated example, an upper support frame 57 is connected to the upper surface 55 of the buoyancy can platform 31 through a plurality of support legs 59. Also in the illustrated embodiment, the support legs 59 allow the buoyancy can platform 31 to be fully submerged with the tensioner units 51 being held above the waterline. In this illustrated example, as perhaps best shown in FIG. 4, a lower or bottom portion 61 of each tensioner cylinder 53 is embedded in a portion of the upper support frame 57. Note, the positioning of the lower portion 61 of cylinders 53 is shown by way of example.

Figure 5:
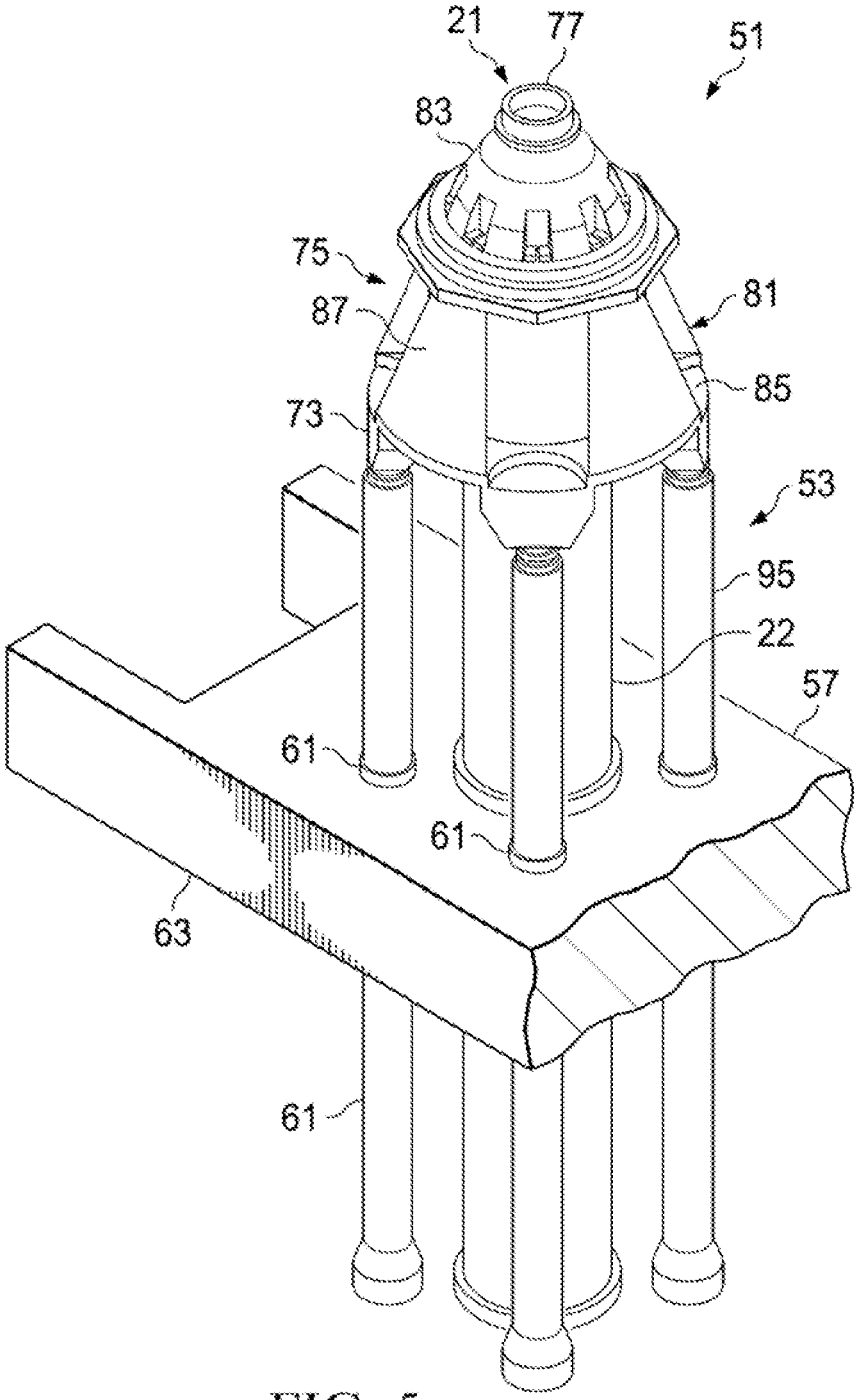
FIG. 5 is an enlarged perspective view of a single short-stroke tensioner unit of FIG. 3 connected to a single riser and extending through a support frame according to an embodiment of the present invention.
Figure 6:
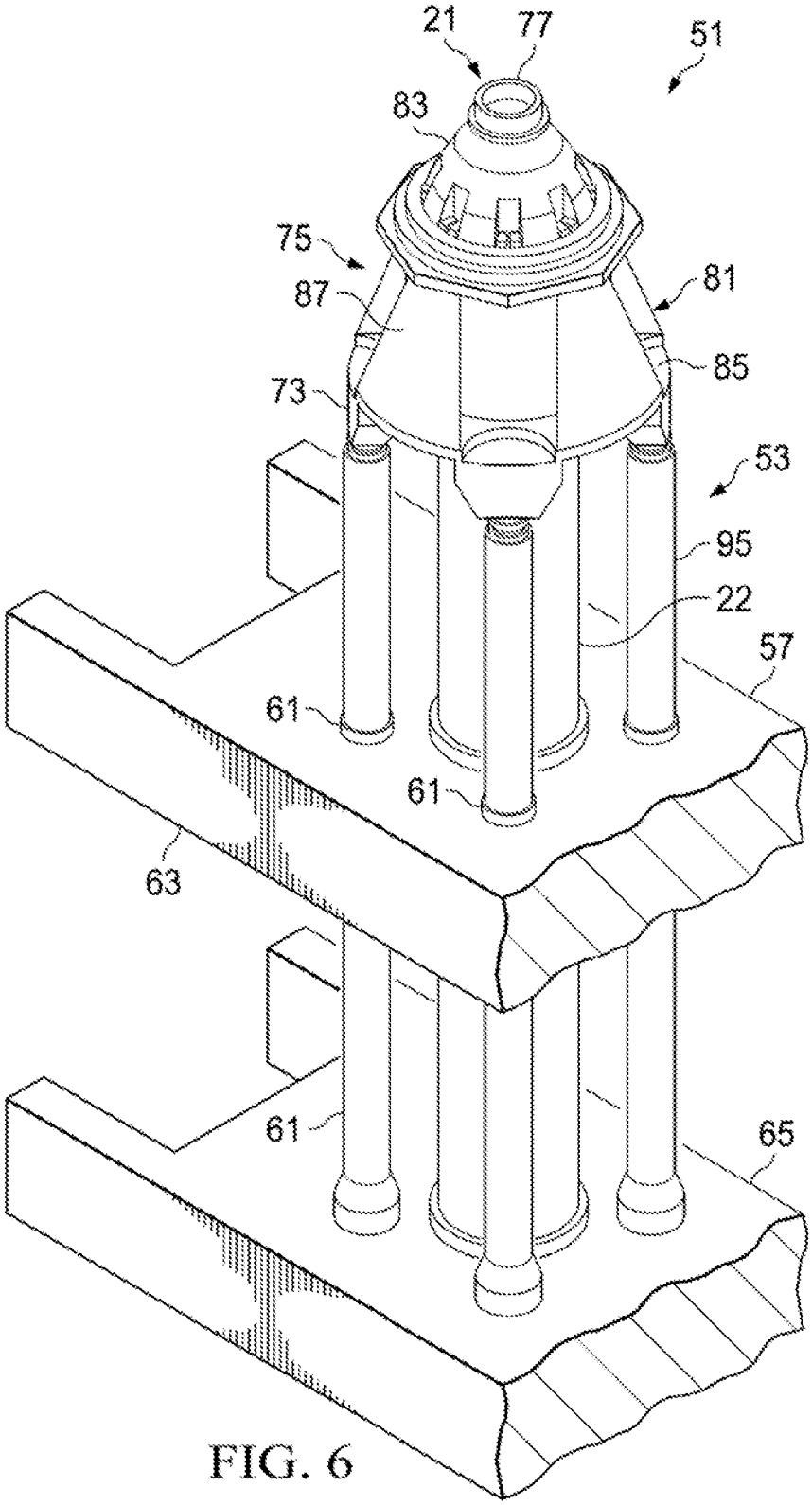
FIG. 6 is an enlarged perspective view of a single short-stroke tensioner unit of FIG. 3 connected to a single riser and extending through an upper support frame and landing upon a lower support frame connected to an upper surface of a buoyancy can according to an embodiment of the present invention.
Figure 7:
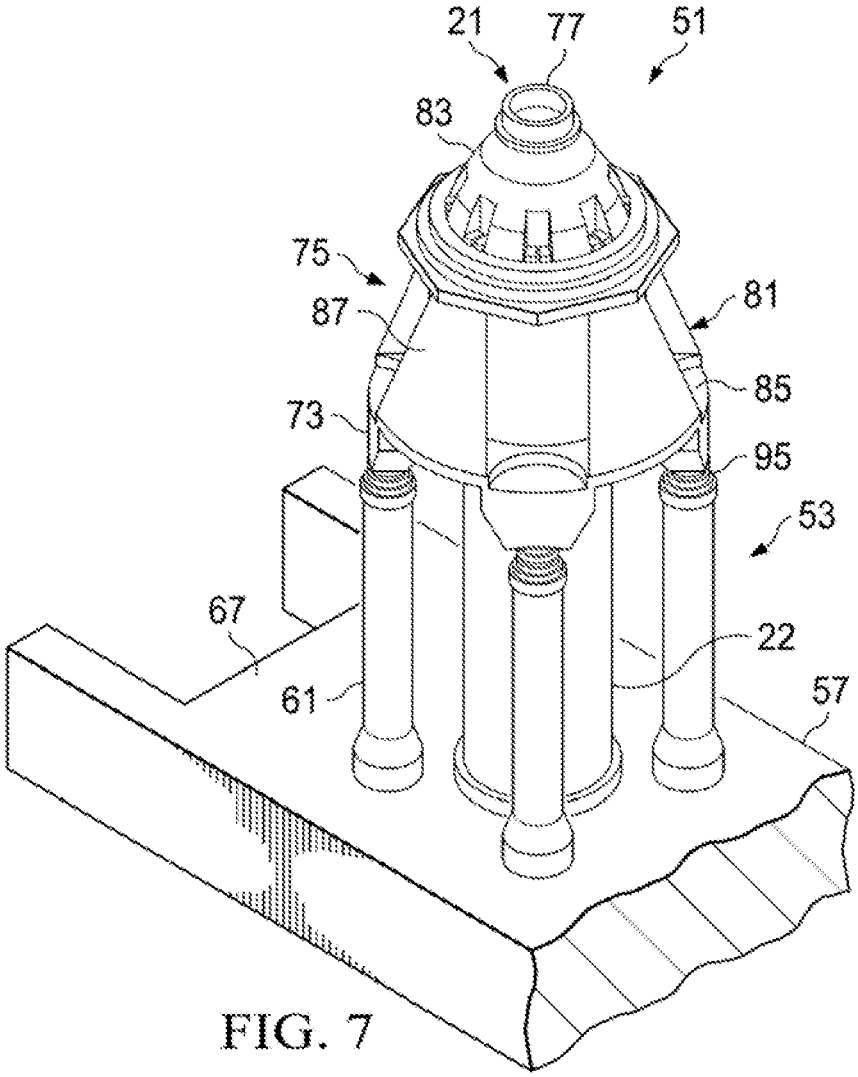
FIG. 7 is an enlarged perspective view of a single short-stroke tensioner unit of FIG. 3 connected to a single riser and landing upon to a surface of a support frame according to an embodiment of the present invention.

Other positioning methodologies are, however, within the scope of the present invention, to include, but not limited to, positioning each of the cylinders 53 so that the bottom portion 61 extends through a bottom surface 63 of the upper support frame 57 as shown, for example, in FIG. 5; lands upon a lower support frame 65 as shown, for example, in FIG. 6; or lands upon an upper surface 67 of upper support frame 57 as shown, for example, in FIG. 7.

Figure 8:
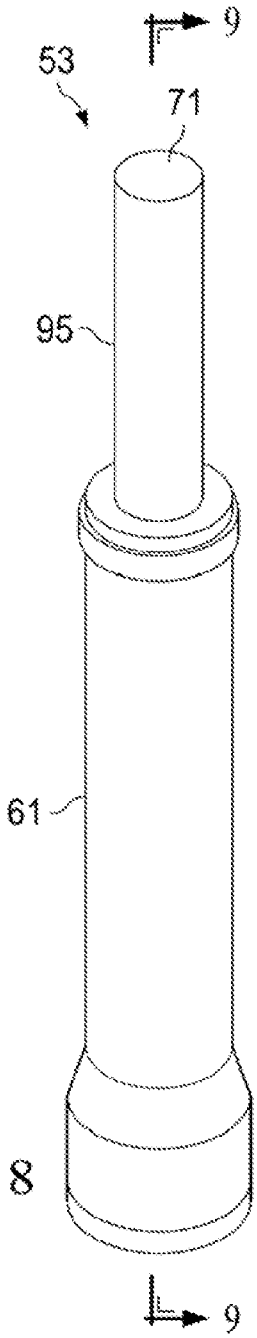
FIG. 8 is an enlarged perspective view of an example of a cylinder for a single short-stroke tensioner unit of FIG. 3 shown in an extended position according to an embodiment of the present invention.

As perhaps best shown in FIG. 8, each tensioning cylinder 53 has an upper end and a lower end. The upper end can include a rod end cap 71. As perhaps best shown in FIGS. 3 and 8, the rod end cap 71, and thus, the upper end of each cylinder 53 can be connected to a bridge 73 which is connected to a tensioner connection assembly 75 to provide the requisite tension to the tensioner connection assembly 75, and thus, to the riser 21. The tension connection assembly 75 can function to collectively provide tensioning forces from each of the tensioning cylinders 53 to a centrally located riser tensioning joint 77, which is connected to a top portion of the riser 21. In the exemplary configuration shown in FIG. 3, the tensioning connection assembly 75 includes a tensioner load frame 81 which is connected to a load ring 83 which is connected to the tensioning joint 77. Note, a bottom portion of the tensioner load frame 81 can include a plurality of apertures 85 to allow easy removal of the tensioning cylinder 53 for replacement, and frame sheets 87 to increase the strength of the load frame 81.

Figure 9:
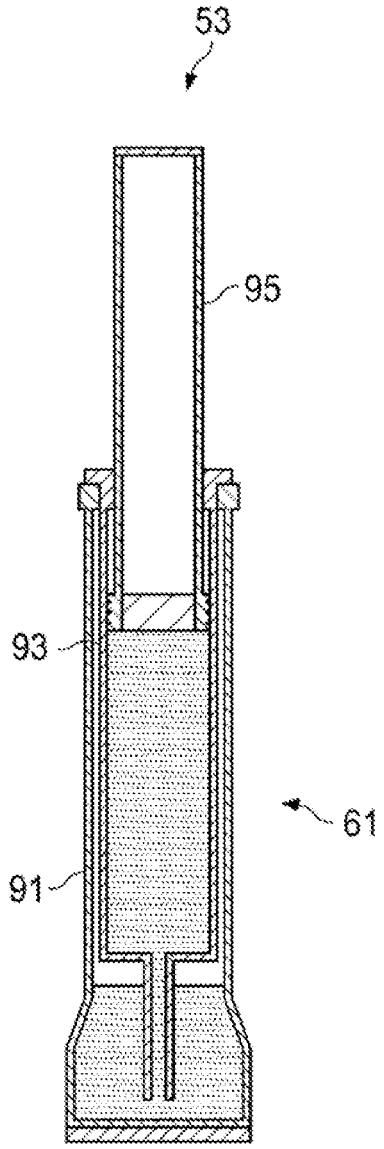
FIG. 9 is a schematic view of an example of a cylinder for a single short-stroke tensioner unit of FIG. 8 according to an embodiment of the present invention.

As perhaps best shown in FIG. 9 for illustrative purposes only, the tensioning cylinder 53, shown in the form of a high stiffness version containing mostly hydraulic fluid and little gas volume, includes a lower or bottom portion or barrel 61 which includes an outer cylinder barrel or main body 91 housing an inner cylinder barrel 93 each having a bore and an aperture on at least one end and having a pressurized fluid contained within. The main body 91 forms an accumulator having a preset volume of gas at a selected pressure set by a user to provide a range of tensioning for the operational environment. A piston 95 is slidably carried in the bore of the barrel 93. The piston 95 of the each cylinder 53 is positioned to function independently of each other of the cylinders 53 for the respective tensioner unit 51. Specifically, each piston 95 is individually positioned to increase pressure of the accumulator when the piston 95 strokes in the direction of the pressurized fluid (downward) during downward movement of the top end of the riser 21 to provide tensioning resistance, and to use pressure within the cylinder 53 to stroke upward to maintain tensioning on the riser 21 when the riser 21 moves upward due to various factors including, for example, thermal growth, a change in subsea wellhead and surface tree spacing distance, and a change in pressure differentials between risers 21. As noted above, these functions are performed, simultaneously, with functions performed by the mono-buoyancy can platform 31 primarily providing tensioning due to relative vertical movement caused by lateral offset of the vessel 25.

Note, although long-stroke tensioner units can be used in place of short-stroke tensioner units 51, short-stroke tensioning units 51 having various stroke capabilities of approximately four feet, six feet, and eight feet, for example, depending upon vessel type and/or configuration and/or water depth, are preferred as they can have a total length of approximately six, eight, and ten feet, respectively, and thus, can allow use of much lower ceilings/spacing between horizontal vessel support structures and less weight to both the vessel 25 and the riser management system 30, along with other advantages. Long stroke tensioner are generally much heavier and require more spacing between floor and ceiling feet.

Figure 10:
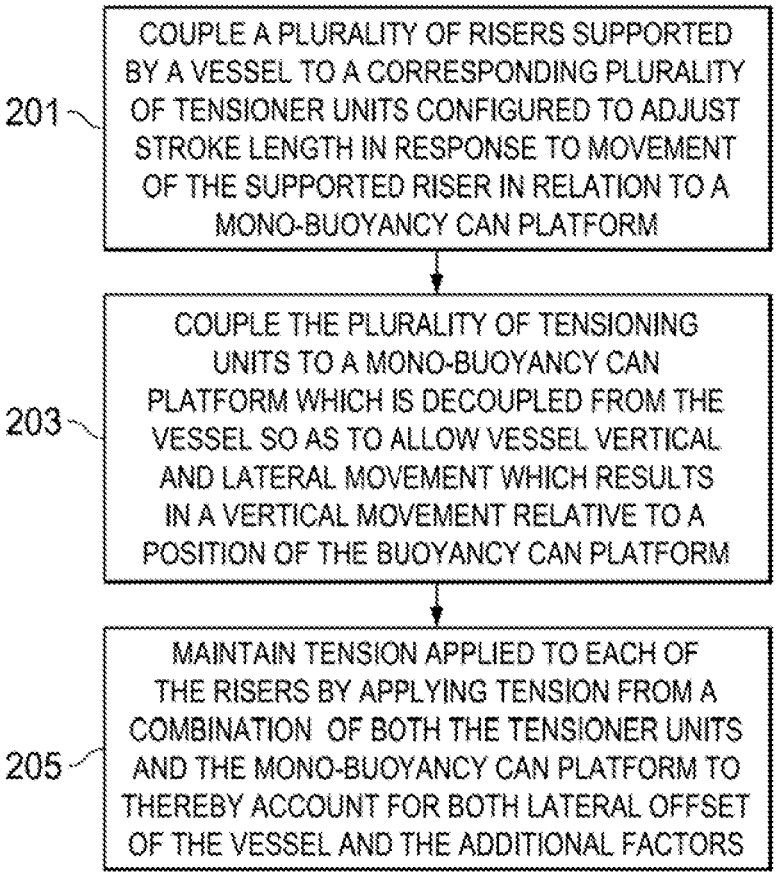
FIG. 10 is a schematic block flow diagram of a method of maintaining a selected range of tension on a plurality of risers extending between subsea well equipment and a floating vessel according to an embodiment of the present invention.

FIG. 10 provides a high level flow diagram of a method of maintaining a selected range of tension on a plurality of risers 21 extending between subsea well equipment 23 and a floating vessel 25 according to an embodiment of the present invention. Specifically, according to an embodiment of such a method, the method can include the step of coupling the risers 21 to a corresponding plurality of tensioner units 51 configured to adjust stroke length in response to movement of the supported riser 21 in relation to a mono-buoyancy can platform 31 (block 201). According to a preferred configuration, each of the tensioning units 51 can include, e.g., three or four tensioning cylinders 53 including a top end portion or piston 95 adapted extend and retract responsive to changes in the one or more additional factors such as, for example, thermal growth of the supported riser 21, a change in subsea wellhead and surface tree spacing distance, and pressure differentials between risers 21 unevenly compensated for by the buoyancy can platform 31, described below, to maintain tension on the supported riser 21 within a certain range of tension values. Each of the tensioning cylinders 53 also includes a bottom end portion defining a barrel 61 configured to receive substantial portions of the piston 95 during retraction, and configured to be fixedly operably connected to the mono-buoyancy can platform 31, as described below. According to one or more preferred configurations, the tensioning units 51 are short-stroke tensioning units 51 having various stroke capabilities of approximately four feet, six feet, and eight feet, depending upon vessel type and/or configuration and/or water depth.

Referring again to FIG. 10, the method of maintaining a selected range of tension on a plurality of risers 21 can include the step of coupling the plurality of tensioning units 51 to the mono-buoyancy can platform 31 which is decoupled from the vessel 25 so as to allow vessel vertical and lateral movement, which results in a vertical movement relative to a position of the buoyancy can platform 31 (block 203). This step can include the step of connecting the barrel 61 of each of the tensioning units 51 to a support frame 57 connected to a top portion of the mono-buoyancy can platform 31, according to the various techniques. For example, according to one configuration, the barrel 61 is positioned embedded within a support frame 57 as shown, for example, in FIG. 4. According to another configuration, the barrel 61 extends below frame 57 as shown, for example, in FIG. 5. According to another configuration, the barrel 61 lands upon a lower support frame 65 as shown, for example, in FIG. 6. According to yet another configuration, the barrel 61 lands upon an upper surface is the 67 of support frame 57 as shown, for example, in FIG. 7. It should be understood, however, that other configurations are within the scope of the present invention. Further, it should be understood that support frame 57 can be separated from an upper surface 55 of the buoyancy can platform 31 or can land upon or be integral with the upper surface 55. The step of coupling the plurality of tensioning units 51 to the mono-buoyancy can platform 31 can also include extending the risers 21 (e.g., housed within riser conductors 28) through interstitial space between the individual buoyancy cans 33 forming of the mono-buoyancy can platform 31.

Referring again to FIG. 10, the method of maintaining a selected range of tension on a plurality of risers 21 can include the step of maintaining tension applied to each of the risers 21 whereby tension is applied by a combination of both the tensioner units 51 and the mono-buoyancy can platform 31 to thereby account for both a vertical offset with the vessel and the additional factors, described above (block 205). That is, according to an embodiment of the method, the step includes simultaneously applying tensioning responsive to tensioning requirements resulting from a change in the lateral offset of the vessel in conjunction with tensioning requirements resulting from a change in the one or more additional factors, with the mono-buoyancy can platform 31 primarily applying tensioning responsive to the change in vertical offset with the vessel 25, and each of the tensioning units 51 separately primarily applying tensioning to its respective riser 21 responsive to the change in the one or more additional factors affecting the respective associated riser 21.

Various embodiments of the present invention have several advantages. For example, various embodiments of the present invention allow an operator to ensure that proper tension to multiple risers 21 simultaneously is maintained due to both changes in the vertical offset with the vessel 25 and additional factors which can simultaneously affect each riser 21 differently, thus otherwise causing significant variations in tensioning requirements between risers 21 when connected to a single buoyancy platform 31. Advantageously, embodiments of the present invention provide a set of multiple cylinders 53 to further support each of a plurality of risers 21 primarily supported by a single buoyancy can platform 31. Advantageously, embodiments of the present invention can utilize short-stroke tensioner units 51 positioned atop the mono-buoyancy can platform 31, which provide a much lower cost tensioning system solution than can be used on conventional SPAR and semi-submersible platforms. Advantageously, according to such configuration or configurations, the stroke variations among individual risers 21 connected to the mono-buoyancy can platform 31 are handled by each individual set of short-stroke tensioner units 51 while the tension requirements due to hull offset are primarily handled by the "mono-can" 31. As a result, the variation in riser tension can be maintained nearly constant, or at least within a tight range of values, for variations in pressure, thermal growth and the various operating conditions separately affecting each individual riser 21. Alternatively, it can be made very stiff (e.g., like a hydraulic jack) such that it primarily only adjusts for initial install variations such as, for example, overall riser length, weight, and pre-set tension. Other advantages have been described above and throughout.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification.

That claimed is:

1. A riser management system for maintaining a selected range of tension on a plurality of risers extending between subsea well equipment and a moored floating vessel, the riser management system comprising:

a mono-buoyancy can platform operably coupled to a plurality of tensioner units, configured to be at least partially submerged, and positioned within and circumscribed by substantial portions of a passageway extending through submerged portions of a hull of a moored floating vessel to provide tension to each of a plurality of risers extending therethrough and between subsea well equipment and the moored floating vessel to collectively compensate for a relative vertical offset between the plurality of risers and the floating vessel during sustained operational employment of the riser management system, the relative vertical offset defining a first factor, the mono-buoyancy can platform being substantially laterally constrained within at least the substantial portions of the passageway extending through the submerged portions of the hull of the moored floating vessel;

the plurality of tensioner units each connected to a top portion of a separate one of the plurality of risers to separately adjust stroke position and to separately provide tension within a preselected range of tension values to each separate one of the plurality of risers to compensate for differential effects of one or more additional factors other than the first factor on one or more of the plurality of risers during sustained operational employment of the riser management system, each of the plurality of tensioner units comprising a plurality of cylinders having a first end portion operably coupled to a riser connector for a respective one of the plurality of risers and a second end portion operably coupled to the mono-buoyancy can platform, each of the plurality of risers coupled to a corresponding different one of the plurality of tensioner units to thereby move independently within an internal structure of the mono-buoyancy can platform.

2. The system as defined in claim 1, wherein the mono-buoyancy can platform and the plurality of tensioner units are configured to simultaneously provide tensioning responsive to a change in the relative vertical offset in conjunction with a separate change in the one or more additional factors separately affecting one or more of the plurality of risers; and wherein the mono-buoyancy can platform is at least substantially decoupled from the hull of the moored floating vessel to allow independent vertical movement therewithin.

3. The system as defined in claim 1, wherein a mono-buoyancy can platform comprises a plurality of buoyancy cans;

wherein each of the plurality of buoyancy cans is operably coupled together to form the mono-buoyancy can platform; and wherein the plurality of risers each extend through interstitial space between the plurality of buoyancy cans of the mono-buoyancy can platform, each of the plurality of risers being de-coupled from movement of the floating vessel through coupling with the mono-buoyancy can platform.

4. A riser management system for maintaining a selected range of tension on a plurality of risers extending between subsea well equipment and a moored floating vessel, the riser management system comprising:

a plurality of buoyancy cans operably coupled to a plurality of tensioner units, each of the plurality of buoyancy cans operably coupled together to form a mono-buoyancy can platform configured to be at least partially submerged and positioned within and circumscribed by substantial portions of a passageway extending through submerged portions of a hull of a moored floating vessel to provide tension to each a plurality of risers extending therethrough and between subsea well equipment and the moored floating vessel to collectively compensate for a relative vertical offset between the plurality of risers and the floating vessel during sustained operational employment of the riser management system, the relative vertical offset defining a first factor, the mono-buoyancy can platform substantially laterally constrained within at least the substantial portions of the passageway extending through the submerged portions of the hull of the moored floating vessel, the mono-buoyancy can platform being at least substantially decoupled from the hull of the moored floating vessel to allow independent vertical movement therewithin; and the plurality of tensioner units each connected to a top portion of a separate one of the plurality of risers to separately adjust stroke position and to separately provide tension within a selected range of tension values to each separate one of the plurality of risers to compensate for differential effects of one or more additional factors other than the first factor on one or more of the plurality of risers during sustained operational employment of the riser management system, each of the plurality of tensioner units comprising a plurality of cylinders having a first end portion operably coupled to a riser connector for a respective one of the plurality of risers and a second end portion operably coupled to the mono-buoyancy can platform, the plurality of risers each extending through interstitial space between the plurality of buoyancy cans of the mono-buoyancy can platform and operably coupled to and a respective different one of the plurality of tensioner units, each of the plurality of risers being de-coupled from movement of the floating vessel through coupling with the mono-buoyancy can platform via the corresponding plurality of tensioner units, the mono-buoyancy can platform and the plurality of tensioner units being configured to simultaneously provide tensioning responsive to a change in the relative vertical offset in conjunction with a change in the one or more additional factors.

5. The system as defined in claim 4, wherein the buoyancy can platform is decoupled from the vessel so as to allow vessel movement relative to a position of the buoyancy can platform without affecting the tension on the plurality of risers; and wherein the additional factors result in a riser tensioning requirement for one of the plurality of risers that is substantially different than the tensioning requirement of one or more other of the plurality of risers.

6. The system as defined in claim 5, wherein the additional factors comprise one or more of the following: a change in riser initial length, riser initial weight, riser initial pre-tension, riser thermal growth, subsea wellhead and surface tree spacing distance, and pressure differentials between risers.

7. The system as defined in claim 5, wherein the plurality of tensioner units is a plurality of short-stroke tensioner units, and wherein each of the plurality of cylinders have a stroke length of no less than approximately two feet and no more than approximately eight feet.

8. The system as defined in claim 5, wherein each of the plurality of tensioner units functions independently of each other of the plurality of tensioner units; and wherein the hull comprises a middeck section and a lower deck section, one or more of the middeck section and the lower deck section including submerged portions of the passageway circumscribing substantial portions of the mono-buoyancy can platform, the vessel being moored to portions of a subsea floor, the mono-buoyancy can platform being laterally constrained within the submerged portions of the passageway extending through one or more of the middeck section and the lower deck section.

9. The system as defined in claim 5, wherein the vessel comprises a non-vertically restrained floating platform positioned in water deeper than approximately 2000 feet.

10. The system as defined in claim 4, wherein the plurality of tensioner units is a plurality of short-stroke tensioner units, and wherein each of the plurality of cylinders have a maximum stroke length of approximately eight feet;

wherein each of the plurality of buoyancy cans is a cylindrically shaped buoyancy can; and wherein each of the plurality of risers are at least partially housed within a corresponding plurality of riser conductors, each of the plurality of riser conductors extending substantially vertically through the mono-buoyancy can platform, each interleaved between a different set of the plurality of cylindrically shaped buoyancy cans.

11. A method of maintaining a selected range of tension on a plurality of risers extending between subsea well equipment and a moored floating vessel, the method comprising the steps of:

coupling a plurality of risers to a corresponding different one of a plurality of tensioner units each configured to individually adjust stroke length in response to movement of the respective riser associated therewith in relation to a mono-buoyancy can platform during sustained operational employment thereof, the plurality of risers free to move independently within an internal structure of the mono-buoyancy can platform;

coupling the plurality of tensioner units to the mono-buoyancy can platform, the mono-buoyancy can platform adapted to maintain tension on the plurality of risers within a certain range of tension values via the coupling with the plurality of tensioner units, the mono-buoyancy can platform positioned within and circumscribed by substantial portions of a passageway extending through submerged portions of a hull of a moored floating vessel, the mono-buoyancy can substantially laterally constrained within at least the substantial portions of the passageway extending through the submerged portions of the hull of the moored floating vessel, the mono-buoyancy can being decoupled from the vessel so as to allow vessel movement relative to a position of the mono-buoyancy can platform; and maintaining tension applied to each of the plurality of risers within a preselected range of tension during sustained operational employment thereof, tension being applied by a combination of both the plurality of tensioner units and the mono-buoyancy can platform via the coupling with the plurality of tensioner units to thereby both collectively account for relative vertical offset between the plurality of risers and the vessel and to separately account for differential effects of one or more additional factors on one or more of the plurality of risers.

12. The method as defined in claim 11, wherein the mono-buoyancy can platform is decoupled from the vessel so as to allow vessel vertical movement relative to a position of the buoyancy can platform; and wherein the step of maintaining tension applied to each of the plurality of risers includes the step of: simultaneously applying tensioning responsive to a change in the relative vertical offset in conjunction with a change in the one or more additional factors.

13. The method as defined in claim 12, wherein step of maintaining tension applied to each of the plurality of risers includes the following steps:

the mono-buoyancy can platform primarily applying tensioning responsive to the change in relative vertical offset; and each of the plurality of tensioner units separately applying tensioning to its respective riser responsive to the change in the one or more additional factors affecting the respective riser associated therewith.

14. The method as defined in claim 13, wherein the additional factors result in a riser tensioning requirement for at least one of the plurality of risers that is substantially different than the tensioning requirement of one or more other of the plurality of risers.

15. The method as defined in claim 14, wherein the step of separately applying tensioning by the plurality of tensioning units includes primarily applying tensioning responsive to the change in the one or more additional factors affecting the respective riser associated therewith; and wherein the additional factors comprise one or more of the following: a change in riser initial length, riser initial weight, riser initial pre-tension, riser thermal growth, subsea wellhead and surface tree spacing distance, and pressure differentials between risers.

16. The method as defined in claim 15, wherein the plurality of tensioner units is a plurality of short-stroke tensioner units each comprising a plurality of tensioning cylinders having a stroke length of between approximately two feet and eight feet.

17. The method as defined in claim 11, wherein each of the plurality of buoyancy cans is operably coupled together to form the mono-buoyancy can platform; and wherein the plurality of risers each extend through interstitial space between the plurality of buoyancy cans of the mono-buoyancy can platform, each of the plurality of risers being de-coupled from movement of the floating vessel through coupling with the mono-buoyancy can platform via the corresponding plurality of tensioner units.

18. The method as defined in claim 11, wherein each of the plurality of tensioner units comprises a separate plurality of tensioning cylinders, each tensioning cylinder comprising a first end portion defining a piston adapted extend and retract to maintain tension on the respective riser within a certain range of tension values and comprising a second end portion defining a barrel configured to receive substantial portions of the piston during retraction thereof; and wherein each of the plurality of tensioner units is connected between the mono-buoyancy can platform and one of the plurality of risers according to one of the following configurations so that the respective piston of the respective tensioning cylinder is oriented to extend and retract responsive to changes in the one or more additional factors:

the barrel is fixedly operably connected to the mono-buoyancy can platform and the piston is fixedly operably connected to the respective riser, and the piston is fixedly connected to the mono-buoyancy can platform and the barrel is fixedly operably connected to the respective riser.

19. The method as defined in claim 18, wherein the step of coupling the plurality of tensioner units to the mono-buoyancy can platform includes the step of: connecting the barrel of each of the plurality of tensioner units to a support frame connected to a top portion of the mono-buoyancy can platform so that the barrel is substantially positioned below an upper surface of the support frame.

20. The method as defined in claim 19, wherein the step of connecting the barrel of each of the plurality of tensioner units to a support frame connected to a top portion of the mono-buoyancy can platform further includes the step of connecting the barrel of each of the plurality of tensioner units so that each respective barrel is positioned above a lower surface of the support frame.

* * * * *